US005992846A

United States Patent [19]

Umeda

[11] Patent Number: 5,992,846

[45] Date of Patent: Nov. 30, 1999

[54] SHEET FEEDER AND PRINTER

[75] Inventor: Takaichiro Umeda, Nagoya, Japan

[73] Assignee: Brother Kogyo Kabushiki Kaisha, Nagoya, Japan

[21] Appl. No.: 08/974,883

[22] Filed: Nov. 20, 1997

[30] Foreign Application Priority Data

Nov. 21, 1996 [JP] Japan ..... 8-310752

[51] Int. Cl.[6] ..... B65H 9/20

[52] U.S. Cl. ..... 271/248; 271/274; 271/10.11; 271/265.01; 271/252; 400/636

[58] Field of Search ..... 271/274, 248, 271/10.03, 10.12, 265.01, 10.09, 10.11, 250, 252; 400/636

[56] References Cited

U.S. PATENT DOCUMENTS

| | | | |
|---|---|---|---|
| 1,022,766 | 4/1912 | Barnard | 400/639 |
| 4,548,394 | 10/1985 | Koyama et al. | 271/10.03 X |
| 5,035,413 | 7/1991 | Yamada et al. | 271/10.03 X |
| 5,067,835 | 11/1991 | Yamamoto et al. | 400/582 |
| 5,069,442 | 12/1991 | Storz | 271/250 |
| 5,222,724 | 6/1993 | Hirano et al. | 271/10.03 |
| 5,540,423 | 7/1996 | Nakano | 271/274 X |
| 5,580,042 | 12/1996 | Taniguro et al. | 271/274 |
| 5,582,399 | 12/1996 | Sugiura | 271/265.01 X |
| 5,738,455 | 4/1998 | Umeda | 400/636 |
| 5,800,076 | 9/1998 | Umeda | 271/274 X |

FOREIGN PATENT DOCUMENTS

| | | |
|---|---|---|
| 1-150651 | 6/1989 | Japan . |
| 3-211130 | 9/1991 | Japan . |

*Primary Examiner*—William E. Terrell
*Assistant Examiner*—Patrick Mackey
*Attorney, Agent, or Firm*—Oliff & Berridge, PLC

[57] ABSTRACT

A sheet feeder includes a feed roller and pressure rollers for feeding a sheet of paper through the nips each between the feed roller and one of the pressure rollers. The feeder also includes a sheet passage for feeding a sheet of paper through it with an edge of the sheet guided along a side edge of the passage. Each of the pressure rollers is urged against the feed roller by an urging member. The guide edge of the passage is spaced from the adjacent end of the feed roller. Fitted between the edge and the end is a detector for detecting the presence of a sheet of paper. The urging member nearest to the guide edge of the passage is greater in urging force than any other urging member. Therefore, the feeder can feed a sheet of paper without inclining it.

24 Claims, 3 Drawing Sheets

SHEET FEEDER AND PRINTER

BACKGROUND OF THE INVENTION

1. Field of the Invention

The present invention relates to a sheet feeder and a printer suitable for an ink jet printing.

2. Description of the Related Art

A sheet sending roller of a known conventional printer sends sheets of paper one after one from the sheet hopper, where the sheets are stored. A sent sheet is fed between a cylindrical feed roller and a set of pressure rollers to the position in front of the print mechanism, where the sheet is printed. The presence of a sheet being fed can be detected by a detecting means fitted near the cylindrical feed roller. The detecting means may include a lever which can be pushed by a sheet, and a sensor for sensing the motion of the lever. By positioning the detecting means as near as possible to the nips each between the cylindrical roller and one of the pressure rollers, it is possible to detect a sheet accurately with the sheet less floating. It is also possible to control the front or rear end position (leading or trailing edges) of a sheet with the cylindrical roller and the pressure rollers with few errors relative to the print mechanism. In the case of a printer where the front end of a sheet is registered at the nips each between the cylindrical roller and one of the pressure rollers, it is further possible to confirm the presence of the sheet securely or certainly.

In the case of a printer where sheets of different widths can be set or stacked in contact with the side wall of the sheet hopper on the reference side, it is necessary to detect a sheet of any width by fitting a detecting means in the sheet passage on this side. In order to position the detecting means near the nips each between the cylindrical feed roller and one of the pressure rollers, it is necessary to form space for the means by cutting the rollers on the reference side. If the rollers are cut, an edge part of a sheet on the reference side of the sheet passage cannot be put between them. This part of a sheet may, due to the resistance of the next sheet and/or the sheet passage, be fed more slowly than other part fed between the cylindrical feed roller and the set of pressure rollers. As a result, a sheet may be fed in an inclined position relative to the feeding direction. In particular, if the detecting means includes a mechanical lever, the resistance of which acts in addition, more sheets may be fed in inclined positions. Consequently, even if the front end of a sheet is positioned and/or an inclination of this end is rectified by registration at the nips each between the cylindrical feed roller and the one of the pressure rollers, these rollers may feed the sheet in an inclined position because of lack of driving force for an edge part of the sheet on the reference side.

In order to prevent the inclination of the sheet feeding, the cylindrical feed roller of a certain printer has a peripheral or circumferential groove formed at a slight distance from the roller end on the reference side. The groove is faced by a detecting means. Because the rubber of the roller end part of the slight width is not stable, however, the desired feed cannot be achieved at this part, and the part may be broken.

SUMMARY OF THE INVENTION

It is an object of the present invention to provide a sheet feeder which includes a feed roller, a sheet passage and a sheet detector fitted between the roller and the reference side of the passage, and which can feed sheets of different widths in the least inclined positions as each sheet is biased to this side. It is another object to provide a printer which includes such a feeder.

In accordance with a first aspect of the invention, a sheet feeder is provided, which includes a sheet passage having a side edge which guides an edge of a sheet of paper to be fed. The feeder also includes a feed roller and a pressure roller, each of which can rotate on an axis extending widthwise of the passage. The rollers can feed the sheet of paper through the nip between them. The end of the feed roller which is adjacent to the guide edge of the passage is spaced axially inward from this edge. The pressure roller is urged by a plurality of urging members against the feed roller at positions spaced widthwise of the passage. The urging member nearest to the guide edge of the passage is greater in urging force than any other urging member. The feeder further includes a detector positioned between the end of the feed roller and the guide edge of the passage. The detector can detect the presence of a sheet of paper, and generate a signal which represents the presence. Because the end of the feed roller is spaced from the guide edge (on the reference side) of the sheet passage, the adjacent edge of a sheet does not contact this roller, which can therefore apply no feeding force to this sheet edge. However, because the urging member nearest to the guide edge of the passage is greater in urging force than any other urging member, sufficient feeding force can be applied to the sheet part near this edge. This prevents the sheet from inclining with respect to the direction in which the sheet is fed.

The pressure roller might be replaced by at least two rollers, each of which is urged against the feed roller by at least one of the urging members. The urging members may be coil springs, rubber other elastic material.

The pressure roller may be supported on one end of a supporting member such as a holder. The supporting member extends upstream of the pressure roller from the one end. The sheet passage may include a passage wall positioned upstream of the feed roller. The supporting member and the wall define a space therebetween, which narrows toward the nip between the rollers. The supporting member and passage wall thus constructed function as guides for feeding a sheet of paper to the nip between the rollers and to the detector.

The urging members may be positioned near the other end of the supporting member than the end supporting the pressure roller. The pressure roller may be urged through the supporting member against the feed roller.

In accordance with a second aspect of the invention, another sheet feeder is provided, which includes a sheet passage having a passage wall and a side edge thereof which guides an edge of a sheet of paper to be fed. This feeder also includes a feed roller and pressure rollers. Each of the feed and pressure rollers can rotate on an axis which extends widthwise of the passage. The feed and pressure rollers can feed a sheet of paper through the nips each between the feed roller and one of the pressure rollers. The end of the feed roller which is adjacent to the guide edge of the passage is spaced axially inward from this edge. This feeder further includes a detector positioned between the end of the feed roller and the guide edge of the passage wall. The detector can detect the presence of a sheet of paper, and generate a signal which represents the presence. Each of the pressure rollers is supported by a supporting member, which can cooperate with the passage wall to guide a sheet of paper to the nip between the feed roller and the associated pressure roller. Each of the supporting members is urged by an urging member so that the associated pressure roller contacts the feed roller compressively. The urging member nearest to the guide edge of the passage wall is greater in urging force than any other urging member.

As stated above, the urging member of this feeder which is nearest to the guide edge of the passage is greater in urging force than any other urging member. Therefore, sufficient feeding force can be applied to the part of a sheet which is near to the guide edge of the passage, and to which the urging force is applied through the pressure roller nearest to this edge. This prevents the sheet from inclining with respect to the feeding direction.

Each of the urging members of this sheet feeder may include a pair of springs fitted on the associated supporting member. The springs are spaced widthwise of the sheet passage. The springs on the supporting member nearest to the detector includes a first spring nearer to the detector. The first spring is greater in urging force than the other spring.

Each of the sheet feeders according to the first and second aspects of the invention may further include a sheet sending roller positioned upstream of the feed roller, and having an axis in parallel with the axes of the other rollers. The sheet sending roller can send a sheet of paper to the nips each between the roller and one of the pressure rollers. A controller can control the rotation of the roller so as to register a sheet of paper at the roller nips by controlling the rotation direction of the feed roller on the basis of the signal from the detector. Even if a sheet of paper inclines with respect to the feeding direction before fed to the roller nips, the registration rectifies the inclination near the nips.

In accordance with a third aspect of the invention, a printer is provided, which includes a sheet passage having a side edge which guides an edge of a sheet of paper to feed it along the side edge of the passage. The feeder also includes a feed roller and a pressure roller, each of which can rotate on an axis extending widthwise of the passage. The rollers can feed a sheet of paper through the nip between them. The end of the feed roller which is adjacent to the guide edge of the passage is spaced axially inward from this edge. The pressure roller is urged by a plurality of urging members against the feed roller at positions spaced widthwise of the passage. The urging member nearest to the guide edge of the passage is greater in urging force than any other urging member. A detector is fitted between the end of the feed roller and the guide edge of the passage. The detector can detect the presence of a sheet of paper, and generate a signal which represents the presence. The feeder further includes a print head positioned downstream from the rollers.

In accordance with a fourth aspect of the invention, another printer is provided, which includes a sheet passage having a passage wall and a side edge thereof which guides an edge of a sheet of paper along the side edge of the passage wall. This feeder also includes a feed roller and pressure rollers. Each of the feed and pressure rollers can rotate on an axis which extends widthwise of the passage. The feed and pressure rollers can feed a sheet of paper through the nips each between the feed roller and one of the pressure rollers. The end of the feed roller which is adjacent to the guide edge of the passage is spaced axially inward from this edge. A detector is fitted between the end of the feed roller and the guide edge of the passage wall. The detector can detect the presence of a sheet of paper, and generate a signal which represents the presence. Each of the pressure rollers is supported by a supporting member, which can cooperate with the passage wall to guide a sheet of paper to the nip between the feed roller and the associated pressure roller. Each of the supporting members is urged by an urging member so that the associated pressure roller contacts the feed roller compressively. The urging member nearest to the guide edge of the passage wall is greater in urging force than any other urging member. This printer further includes a print head positioned downstream from the rollers.

As stated above, the urging member of each printer which is nearest to the guide edge of the passage wall is greater in urging force than any other urging member. Consequently, the feed and pressure rollers can feed, toward the print head positioned downstream from them, a sheet of paper without inclining it with respect to the direction in which it is fed. It is therefore possible to print sheets even of various widths with high quality.

It is preferable that each of the printers be an ink jet printer, which can eject ink onto a sheet of paper. The detector of each of the sheet feeders and the printers may include a lever which can swing on an axis parallel with the axes of the rollers. In the absence of the sheet of paper at a predetermined part of the passage, one end of the lever protrudes into the sheet passage. The lever is swung by a sheet of paper moving through this part of the passage. The detector may also include a sensor for sensing the motion of part of the lever.

BRIEF DESCRIPTION OF THE DRAWINGS

A preferred embodiment of the present invention is shown in the accompanying drawings, in which.

DETAILED DESCRIPTION OF THE EMBODIMENT

Figure 1:
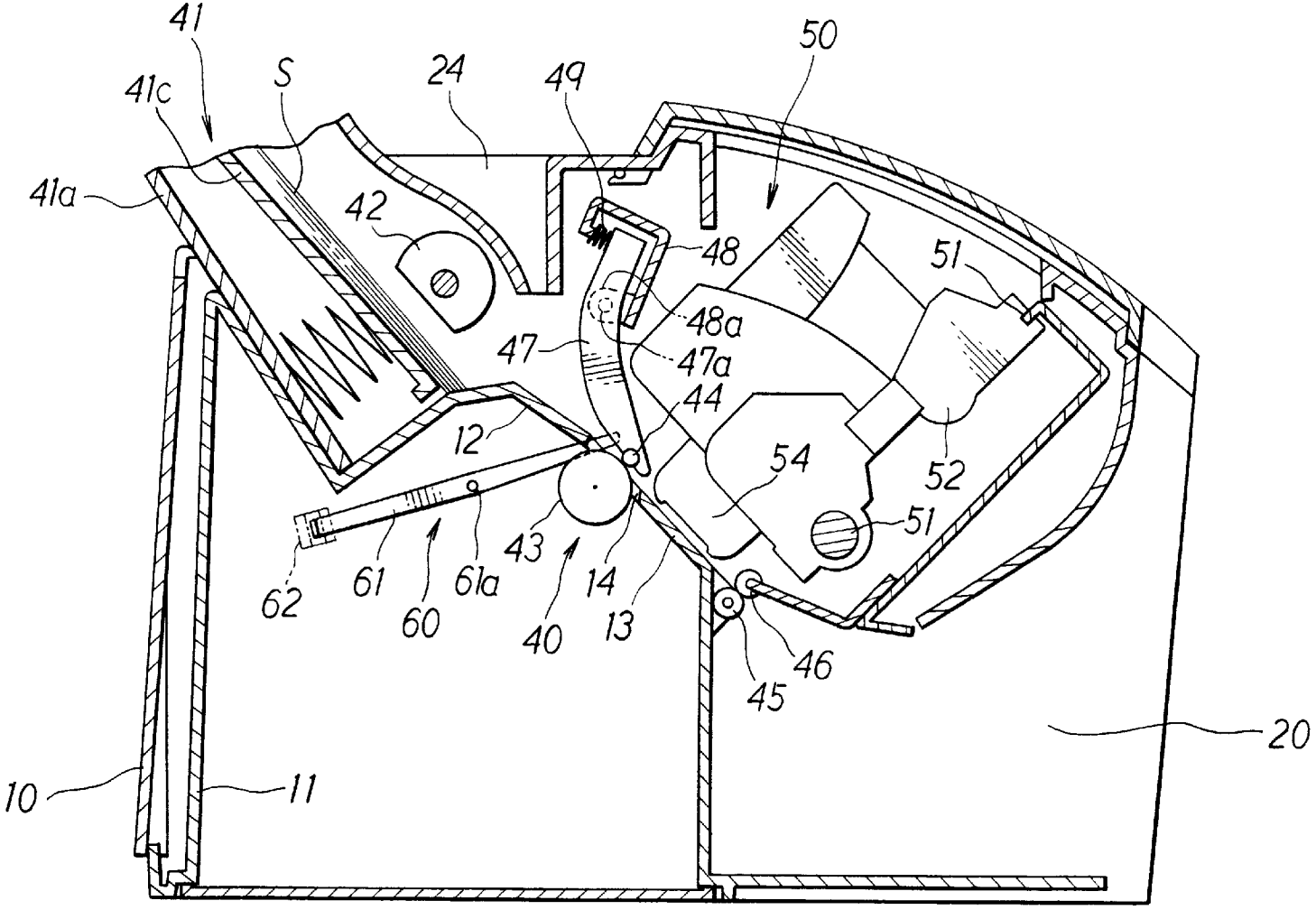
FIG. 1 is a cross section of an ink jet printer according to the embodiment.

With reference to the drawings, an ink jet printer according to the present invention includes a sheet feeder 40 and a print mechanism 50. The feeder 40 includes a sheet hopper 41, a pair of semi-cylindrical feed rollers (sheet sending rollers) 42, a cylindrical feed roller 43 and a set of three pressure rollers 44. The axes of the rollers 42, 43 and 44 are horizontal and parallel to each other. The sheets of paper S stored in the hopper 41 can be sent one after one by the semi-cylindrical feed rollers 42. A sent sheet is fed by and between the cylindrical feed roller 43 and the set of pressure rollers 44 to the position in front of the print mechanism 50, where the sheet is printed. The printed sheet is discharged by and between the lines of discharge rollers 45 and 46, and through the discharge port 20 out of the printer.

The print mechanism 50 includes guide rails 51 in parallel with the axes of the rollers 42, 43 and 44. The rails 51 are also parallel with the front and rear ends of the sheets S sent from the hopper 41, and are perpendicular to the direction in which the sheets can be fed. The rails 51 support a carriage 52, which can reciprocate along them, and on which an ink jet print head 54 is mounted. While the carriage 52 is reciprocated by a drive source (not shown), the head 54 can eject droplets of ink onto the sheet S moving under it. As a result, the sheet S can be printed with images, which may include characters and/or graphic forms, in the form of dot matrixes.

The sheet hopper 41 includes a box 41*a* and a sheet support 41*c*, on which sheets of paper S can be stacked. The box 41*a* includes a pair of vertical side walls and a back wall. The support 41*c* is supported at its top (not shown) by the box 41*a* pivotably on an axis parallel with the axis of the semi-cylindrical feed rollers 42. The support 41*c* is urged near its bottom toward the semi-cylindrical feed rollers 42 by compression springs 41*d*.

Figure 2:
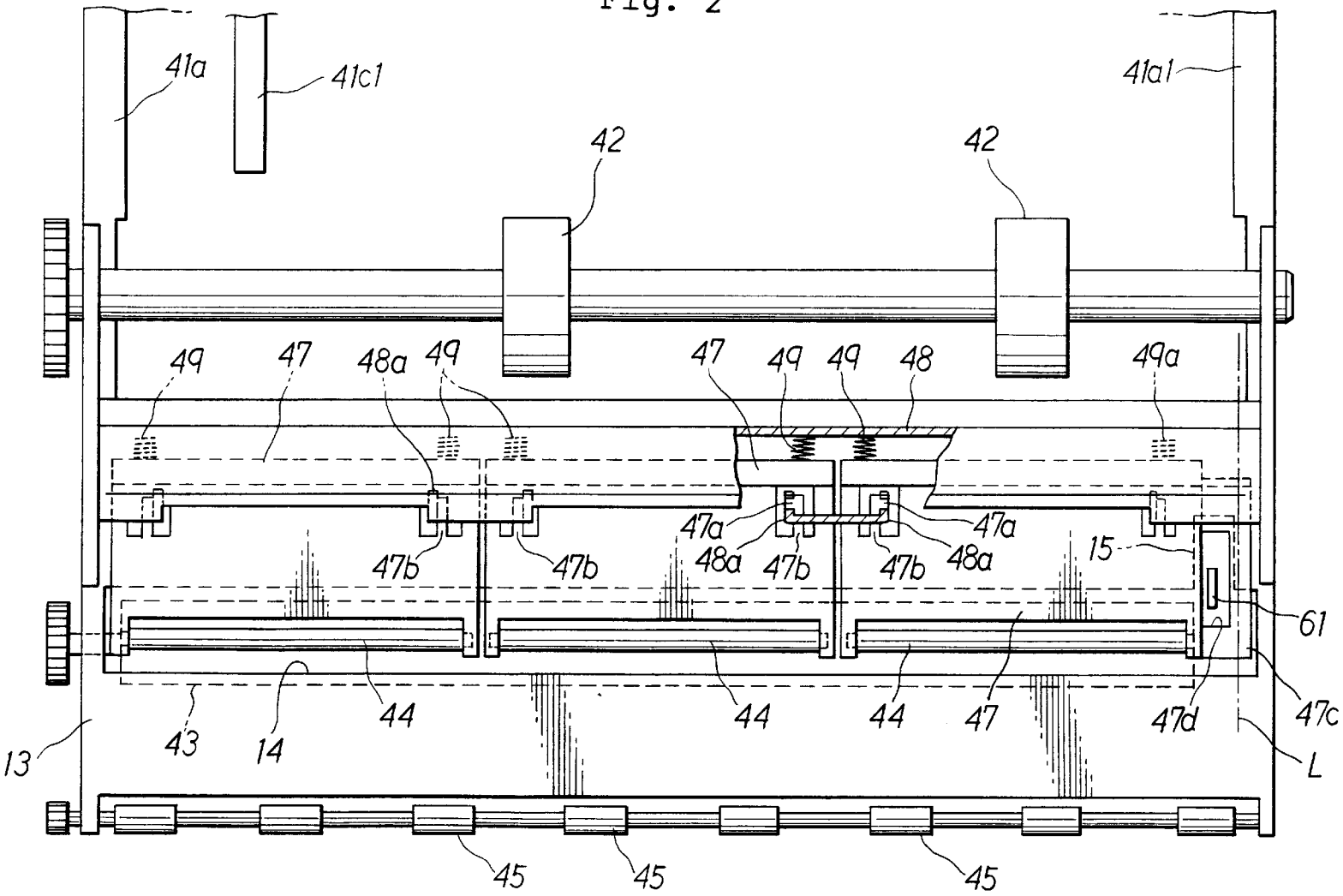
FIG. 2 is an enlarged top plane of the sheet feeder of the printer.

The right side wall 41*a*1 of the box 41*a* shown in FIG. 2 is the reference wall for the sheets S stacked on the support 41*c*. The right edges of the sheets S are positioned in contact with the reference wall 41*a*1, while the left edges are guided by a movable guide 41*c*1, which is mounted crosswise movably on the support 41*c*. A sheet of paper can, with its right edge aligned with a production line L from the inner surface of the reference wall 41*a*1, be fed along the sheet passage extending through the nips each between the cylindrical feed roller 43 and one of the pressure rollers 44.

The printer also includes a frame 11, which supports the print mechanism 50 and the sheet feeder 40. The upper parts of the frame 11 between the sheet hopper 41*a* and the position facing the print mechanism 50 are passage walls 12 and 13, which form the bottom of the sheet passage. The periphery of the cylindrical feed roller 43 is exposed partially through the slot or opening 14 between the passage walls 12 and 13 to the sheet passage.

Each pressure roller 44 is supported rotatably on the bottom of a roller holder 47. Each holder 47 includes a pair of horizontal pivot pins 47*a* formed upstream from the pressure rollers 44 and at a distance from the passage wall 12. The sheet passage formed between the upstream or rear surface of each holder 47 and the wall 12 narrows gradually toward the nip between the cylindrical feed roller 43 and the associated pressure roller 44.

Each roller holder 47 also includes a pair of elastic arms 47*b* (FIGS. 2 and 3), from each of which one of the pivot pins 47*a* protrudes. A holder support 48 includes bent bearings 48*a*, on which the pins 47*a* are supported rotatably. The pins 47*a* have a common axis in parallel with the axes of the rollers 42, 43 and 44. As shown in FIG. 2, the right and left ends of the top of each holder 47 are urged by a pair of springs 49 so that the pressure rollers 44 are in compressive contact with the cylindrical feed roller 43.

The outer case 10 of the printer has an opening 24 for manual paper feed, which is formed between the pair of semi-cylindrical feed rollers 42 and the set of rollers 43 and 44. As the reference position for manual sheet insertion, the right end of the opening 24 is aligned with the right side wall 41*a*1 of the sheet hopper 41.

A detector 60 for detecting the presence of a sheet is fitted upstream from and near the cylindrical feed roller 43. On the basis of the signals from the detector 60, a controller 100 for controlling the printer operation controls the driving of the rollers 42, 43, 44, 45 and 46. The detector 60 includes a lever 61 and a detecting element 62. The lever 61 can swing on a pin or shaft 61*a*, which is parallel with the axes of the rollers. The detecting element 62 can be operated by the lever 61, and may be a photo-interrupter.

The detector is used for detecting as to whether or not the sheet exists on or near the nips (registration position) between on the cylindrical feed roller 43 and the pressure rollers 44. When the sheet has been detected by the detector, that is, the sheet has reached to the nips (or close thereto), then the detector generates a signal for driving the feed roller 43 to feed the sheet in corporation with the pressure rollers 44 to a position at which printing is performed by the printing head 54. If the sheet is not detected by the detector, it does not generate any signals for activating the feed roller 43, but generates a signal for driving the semi-cylindrical feed rollers 42 to feed a sheet to the nip between the rollers 43 and 44. At the nip or therenear, a sheet registration is performed to correct an inclination of the sheet with respect to the feeding direction, as described later.

Figure 3:
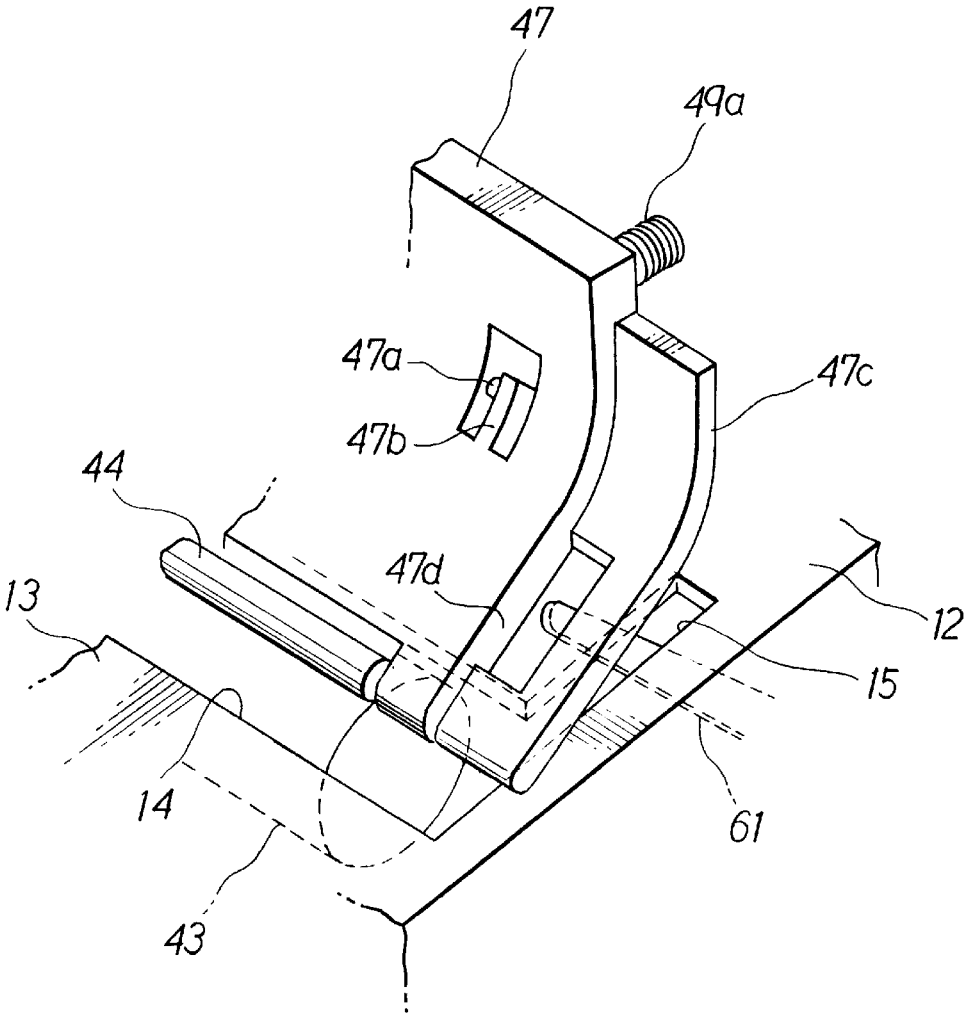
FIG. 3 is an enlarged perspective view of part of the feeder.

In order for the lever 61 to protrude into the sheet passage, the right ends of the cylindrical feed roller 43 and the right pressure roller 44 are spaced at a predetermined distance axially inward from the reference position or line L of the passage. The passage wall 12 upstream from the feed roller 43 has an opening 15 formed near its right end, through which a front end part of the lever 61 extends. The opening 15 extends between the upstream side of the feed roller 43 and the position facing the right end of this roller 43. The right roller holder 47 includes an extension 47*c* protruding from its right end outward or toward the reference line L. The extension 47*c* has an opening 47*d*, which overlaps with the wall opening 15. In the absence of a sheet, as shown in FIG. 3, a front end part of the lever 61 extends through the wall opening 15 and the sheet passage into the extension opening 47*d*, and is positioned upstream from the feed roller 43. When there is a sheet, it forces the front end of the lever 61 into the wall opening 15, where this lever end faces the right end of the feed roller 43.

The right spring 49*a* which urges the right pressure roller 44 is greater in urging or compressive force than the other springs 49. This increases the feeding force of the cylindrical feed roller 43 and pressure roller 44 near the reference line L, compensating for lack of feeding for the sheet part outside the right ends of these rollers.

A sheet of paper S sent from the hopper 41 by the semi-cylindrical feed rollers 42 is guided by the passage wall 12 and roller holders 47. When the front end of the sheet S has come into contact with the nips each between the cylindrical feed roller 43 and one of the pressure rollers 44, this feed roller 43 is either stopping or rotating reversely (counterclockwise in FIG. 1), so that the sheet is not fed toward the print mechanism 50. The contact with the roller nips registers the front end of the sheet S by positioning it and rectifying its inclination (sheet registration). The side edge part of the sheet S near the reference line L touches and pushes the lever 61 before reaching the nips each between the cylindrical feed roller 43 and one of the pressure rollers 44. When the lever 61 is pushed, it swings on the pin 61*a* so that its front end moves to the position on the right of the cylindrical feed roller 43. Consequently, the lever 61 detects the sheet edge part at a position very near to the nip between the feed roller 43 and the right pressure roller 44, while the movement of this sheet part is limited or regulated between the wall 12 and extension 47*c*. Therefore, the sheet can, without floating, be detected reliably with fewer errors.

As stated above, the cylindrical feed roller 43 is spaced from the reference side edge of the sheet passage because of the presence of the lever 61, but the end on this side of the right pressure roller 44 is urged with greater force by the spring 49*a* against the feed roller 43. Therefore, even if the edge part of a sheet S outside the ends of the rollers 43 and 44 on the reference side is resisted, this part can be fed with great force in such a manner that it seldom inclines. Consequently, the print mechanism can print the sheet in the least inclined position.

Although an ink jet printer according to the invention has been described by way of preferred embodiment, the invention is not limited to the embodiment, but may include improvements and modifications or variations which can be thought of by those skilled in the art. The printer of the invention should be interpreted or construed within the range of the appended claims and their equivalents. For example, the more than two springs may be apply to each holder (supporting member) to urge each pressure roller to the feeding roller.

What is claimed is:

1. A sheet feeder comprising:

a sheet passage having a side edge which guides an edge of a sheet of paper to be fed;

a feed roller and a pressure roller for feeding the sheet of paper through a nip between the rollers, each of the roller being rotatable on an axis which extends transverse to the passage, a first end of the feed roller being adjacent to and spaced axially inward from the side edge of the passage;

at least two urging members which urge the pressure roller against the feed roller, one of the urging members being nearer to the edge of the passage and greater in urging force than any other urging member; and a detector for detecting the presence of a sheet of paper, the detector being positioned between the first end of the feed roller and the side edge of the passage.

2. A sheet feeder according to claim 1, wherein the pressure roller includes at least two rollers, each of which is urged against the feed roller by at least one of the urging members.

3. A sheet feeder according to claim 1, and further comprising a supporting member which supports the pressure roller on one end thereof, the supporting member extending upstream of the pressure roller from the one end of the supporting member, the sheet passage including a passage wall positioned upstream of the feed roller, the supporting member and the passage wall defining a space therebetween, which narrows toward the nip between the feed roller and the pressure roller.

4. A sheet feeder according to claim 3, wherein the urging members are positioned near another end of the supporting member, the pressure roller being urged through the supporting member against the feed roller.

5. A sheet feeder according to claim 1, and further comprising:

a sheet sending roller for sending the sheet of paper to the nip between the feed roller and the pressure roller, the sheet sending roller being positioned upstream of the feed roller, the sheet sending roller having an axis in parallel with the axis of the feed roller; and a controller for controlling the rotation of the feed roller so as to register the sheet of paper at the nip between the feed roller and the pressure roller by controlling the rotation direction of the feed roller on the basis of the signal from the detector.

6. A sheet feeder according to claim 1, wherein the detector includes:

a lever which can swing on an axis parallel with the axis of the feed roller, one end of the lever protruding into the sheet passage in the absence of the sheet of paper at a predetermined part of the passage, the lever being swung by the sheet of paper moving through the predetermined part of the passage; and a sensor for sensing the motion of a part of the lever.

7. A sheet feeder comprising:

a sheet passage having a passage wall and a side edge thereof which guides an edge of a sheet of paper to be fed;

a feed roller and a plurality of pressure rollers for feeding the sheet of paper through a nip between the roller and each of the pressure rollers, each of the feed and pressure rollers being rotatable on an axis which extends transverse to the passage, a first end of the feed roller being adjacent to and spaced axially inward from the edge of the passage wall;

a detector for detecting the presence of a sheet of paper, the detector being positioned between the first end of the feed roller and the side edge of the passage wall;

a plurality of supporting members each of which supports one of the pressure rollers, and can cooperate with the passage wall to guide the sheet of paper to the nip between the feed roller and the associated pressure roller; and a plurality of urging members each of which urges one of the supporting members to bring the associated pressure roller into compressive contact with the feed roller, one of the urging members being nearer to the side edge of the passage wall and greater in urging force than any other urging member.

8. A sheet feeder according to claim 7, wherein each of the urging members includes a pair of springs fitted on the associated supporting member, the springs being spaced widthwise along the sheet passage, the supporting members including a first supporting member nearest to the detector, one of the springs on the first supporting member being nearer to the detector and greater in urging force than the other spring.

9. A sheet feeder according to claim 7, wherein a space between each of the supporting members and the passage wall narrows toward the nip between the associated pressure roller and the feed roller.

10. A sheet feeder according to claim 7, and further comprising:

a sheet sending feed roller for sending the sheet of paper to the nips each between the feed roller and one of the pressure rollers, the sheet sending roller being positioned upstream of the feed roller, the sheet sending roller having an axis in parallel with the axis of the feed roller; and a controller for controlling the rotation of the feed roller so as to register a sheet of paper at the nips between the feed roller and pressure rollers by controlling the rotation direction of the feed roller on the basis of the signal from the detector.

11. A sheet feeder according to claim 7, wherein the detector includes:

a lever which can swing on an axis parallel with the axis of the feed roller, one end of the lever protruding into the sheet passage in the absence of the sheet of paper at a predetermined part of the passage, the lever being swung by the sheet of paper moving through the predetermined part of the passage; and a sensor for sensing the motion of a part of the lever.

12. A sheet feeder according to claim 11, wherein the supporting member nearest to the detector has an opening into which the end of the lever protrudes.

13. A sheet feeder according to claim 7, wherein the urging members are coil springs.

14. A printer comprising:

a sheet passage having a side edge which guides an edge of a sheet of paper to be fed;

a feed roller and a pressure roller for feeding the sheet of paper through a nip between the rollers, each of the rollers being rotatable on an axis which extends transverse to the passage, a first end of the feed roller being adjacent to and spaced axially inward from the side edge of the passage;

at least two urging members which urge the pressure roller against the feed roller, one of the urging members being nearer to the edge of the passage and greater in urging force than any other urging member;

a detector for detecting the presence of a sheet of paper, the detector being positioned between the first end of the feed roller and the side edge of the passage; and a print head fitted downstream of the feed and pressure rollers.

15. A printer according to claim 14, wherein the pressure roller includes at least two rollers, each of which is urged against the feed roller by at least one of the urging members.

16. A printer according to claim 14, and further comprising a supporting member which supports the pressure roller on one end thereof, the supporting member extending upstream of the pressure roller from the one end of the supporting member, the sheet passage including a passage wall positioned upstream of the feed roller, the supporting member and the passage wall defining a space therebetween, which narrows toward the nip between the feed roller and the pressure roller.

17. A printer according to claim 16, wherein the urging members are positioned near another end of the supporting member, the pressure roller being urged through the supporting member against the feed roller.

18. A printer according to claim 14, and further comprising:

a sheet sending roller for sending the sheet of paper to the nip between the feed roller and the pressure roller, the sheet sending roller being positioned upstream of the feed roller, the sheet sending roller having an axis in parallel with the axis of the feed roller; and a controller for controlling the rotation of the feed roller so as to register the sheet of paper at the nip between the feed roller and the pressure roller by controlling the rotation direction of the feed roller on the basis of the signal from the detector.

19. A printer comprising:

a sheet passage having a passage wall and a side edge thereof which guides an edge of a sheet of paper to be fed;

a feed roller and a plurality of pressure rollers for feeding the sheet of paper through a nip between the feed roller and each of the pressure rollers, each of the feed and pressure rollers being rotatable on an axis which extends transverse to the passage, a first end of the feed roller being adjacent to and spaced axially inward from the side edge of the passage wall;

a detector for detecting the presence of a sheet of paper, the detector being positioned between the first end of the feed roller and the side edge of the passage wall;

a plurality of supporting members each of which supports one of the pressure rollers, and can cooperate with the passage wall to guide the sheet of paper to the nip between the feed roller and the associated pressure roller;

a plurality of urging members each of which urges one of the supporting members to bring the associated pressure roller into compressive contact with the feed roller, one of the urging members being nearer to the side edge of the passage wall and greater in urging force than any other urging member; and a print head fitted downstream of the feed and pressure rollers.

20. A printer according to claim 19, wherein each of the urging members includes a pair of springs fitted on the associated supporting member, the springs being spaced widthwise along the sheet passage, the supporting members including a first supporting member nearest to the detector, one of the springs on the first supporting member being nearer to the detector and greater in urging force than the other spring.

21. A printer according to claim 19, wherein a space between each of the supporting members and the passage wall narrows toward the nip between the associated pressure roller and the feed roller.

22. A printer according to claim 21, and further comprising:

a sheet sending roller for sending the sheet of paper to the nips each between the feed roller and one of the pressure rollers, the sheet sending roller being positioned upstream of the feed roller, the sheet sending roller having an axis in parallel with the axis of the feed roller; and a controller for controlling the rotation of the feed roller so as to register a sheet of paper at the nips between the feed roller and pressure rollers by controlling the rotation direction of the feed roller on the basis of the signal from the detector.

23. A printer according to claim 14, which is an ink jet printer.

24. A printer according to claim 19, which is an ink jet printer.

* * * * *